US005231858A

United States Patent [19]

Yamashita et al.

[11] Patent Number: 5,231,858

[45] Date of Patent: Aug. 3, 1993

[54] METHOD OF CONTROLLING EDGE DROP IN COLD ROLLING OF STEEL

[75] Inventors: Michio Yamashita; Ikuo Yarita; Teruhiro Saito, all of Chiba, Japan

[73] Assignee: Kawasaki Steel Corporation, Kobe, Japan

[21] Appl. No.: 797,905

[22] Filed: Nov. 26, 1991

[30] Foreign Application Priority Data

Nov. 30, 1990 [JP] Japan ..... 2-330010
Nov. 30, 1990 [JP] Japan ..... 2-330011
Nov. 30, 1990 [JP] Japan ..... 2-330012

[51] Int. Cl.[5] ..... B21B 1/28; B21B 31/18; B21B 37/02

[52] U.S. Cl. ..... 72/12; 72/16; 72/234; 72/247

[58] Field of Search ..... 72/9, 12, 16, 234, 247

[56] References Cited

U.S. PATENT DOCUMENTS 4,658,620 4/1987 Masui et al. ..... 72/234
4,864,836 9/1989 Ochiai ..... 72/11
4,910,988 3/1990 Ikeda et al. ..... 72/247

FOREIGN PATENT DOCUMENTS 0110401 6/1984 Japan ..... 72/247
0068101 4/1985 Japan ..... 72/247
0154709 7/1986 Japan ..... 72/247

*Primary Examiner*—Lowell A. Larson
*Assistant Examiner*—Thomas C. Schoeffler
*Attorney, Agent, or Firm*—Dvorak and Traub

[57] ABSTRACT

A method for controlling edge drop in a cold rolling operation adaptable to tandem cold rolling mill stands by shifting a pair of vertically disposed single-end-tapered work rolls along the widthwise direction of a steel strip. The work rolls have tapered end portions that are disposed on the two widthwise ends of the steel strip. Pairs of work rolls are sequentially mounted on one or more stands and a pair of vertically disposed plain rolls are mounted on at least a final stand, wherein cold rolling is performed so that the thickness offset in the widthwise direction of the steel strip is controlled by independently adjusting the position of the single-end-tapered work rolls according to the following steps: measuring the edge drop at each widthwise end of the steel strip on the outlet side of the final stand; calculating the edge drop offset between the measured amount of the edge drop and a target amount of the edge drop on the final stand outlet side; and individually changing the shift position of the vertically disposed single-end-tapered work rolls in accordance with the edge drop offset at the widthwise ends.

4 Claims, 8 Drawing Sheets

METHOD OF CONTROLLING EDGE DROP IN COLD ROLLING OF STEEL

BACKGROUND OF THE INVENTION

1. Field of the Invention

The present invention relates to a method of cold rolling steel capable of preventing generation of edge drop by using tandem cold rolling mill stands.

2. Related Art Statement

Hitherto, it has been known that a rapid reduction in thickness (hereinafter called "edge drop") can take place in two widthwise ends of a steel strip during the process of cold-rolling the steel strip.

This problem can occur due to an axial directional metal flow generated at the two side end portions of the steel strip and the oblate surface of the work roll which comes in contact with the steel strip. As described, it depends upon the cold rolling conditions.

For overcoming the problem of the edge drop, there has been available in the prior art a method which involves tapering end portions of work rolls for so-called single-end-tapered work rolls disposed vertically and positioned at the two end portions of a steel strip, in order that the geometrical shape of the roll gap is improved.

Another method has been disclosed in Japanese Patent Publication No. 2-4364 in which the rolling mill including the above-described single-end-tapered work rolls is mounted on at least the first stand of the tandem cold rolling mill stands and a plain work roll is as well as mounted on at least the final stand on the outlet side.

In addition, another method has been disclosed in Japanese Patent Laid-Open No. 60-12213 in which the amount of the edge drop of the steel strip on the final stand outlet side in the above-described tandem cold rolling mill stands is measured, the measured amount of the edge drop and a target amount of the edge drop are subjected to a comparison, and accordingly controlling the widthwise directional amount of shift of the work roll having the above-described tapered portion and the roll bender pressure.

In the above-described method in which the edge drop is controlled by shifting the single-end-tapered work rolls, the vertically-disposed work rolls are shifted by the same distance in the opposing directions. Therefore, in a case where the amounts of the edge drop of the steel strip generated due to the hot rolling operation are different from each other between the two widthwise end portions, the edge drop on both sides may not be corrected because the same amount of the edge drop cannot be obtained at the widthwise end portions by shifting the single-end-tapered work roll in accordance with one amount of the edge drop measured by the edge drop gauge with a target amount of the edge drop. Ever worse, is a case where the amounts of the edge drop generated by the hot rolling operation are considerably different from each other between the two widthwise end portions. The problem cannot be overcome by the conventional method. The conventional method may result in a great amount of the edge drop being generated at one end portion and the occurrence of edge-up at another end portion. Furthermore, if the vertically disposed single-end-tapered work rolls are simultaneously shifted in the same direction, a contraction and zigzag movement may take place on the mill inlet side because the steel strip tends to move in the direction of the work rolls. For this reason, the conventional method of correcting edge drop has not satisfactorily overcome the above-described problems.

In the case where the edge of the steel strip is not cut in the pickling process, the width deviation generated in the hot rolling operation is undesirably maintained.

The position at which the amount of the edge drop is measured for use in the above-described cold rolling process, defined by the distance from the widthwise end portion in the cold rolling process, and the position at which the amount of the edge drop is detected, defined by the distance from the widthwise end of the final product, are different from each other due to the above-described width deviation when the final product is obtained by cutting the edge after the cold rolling process. As a consequence, a product displaying equal edge drop in its lengthwise direction cannot always be obtained even if the above-described control is performed in the cold rolling process.

Furthermore, since the width deviation affects the occurrence of the edge drop in the cold rolling process, the change in the edge drop in the cold rolling process becomes too large even if the above-described control is performed in the cold rolling process.

When the number of the stands on which the rolling mills each having a single-end-tapered work roll are mounted is not sufficiently large, it takes time for the portion of the steel strip to be controlled to be conveyed to the final stand outlet side. The delay exists even if the amount of shift of the single-end-tapered work roll is changed for the purpose of reducing the edge drop in the subject rolling mill. The conventional method cannot cause a satisfactory response if the disturbance is changed such that the thickness distribution or acceleration/deceleration of the rolling mill which affects the generation of the edge drop at the time of the cold rolling process is changed. Therefore, the amount of the edge drop cannot be maintained at a constant value in the lengthwise direction of the steel strip. As a result, the manufactured product may display edge drop or edge up at the side ends of the steel strip.

SUMMARY OF THE INVENTION

The present invention overcomes the foregoing problems.

According to one aspect of the present invention, there is provided an edge drop control method for a cold rolling operation adaptable to tandem cold rolling mill stands capable of shifting a pair of vertically disposed single-end-tapered work rolls each having a tapered end portion. The tapered end portion is ground to form a pointed shape that is disposed on the widthwise ends of the steel strip. The tapered work rolls are sequentially mounted on one or more stands including at least a first stand and a pair of vertically disposed plain rolls are mounted on at least a final stand. The cold rolling is performed in such a manner that the thickness offset in the widthwise direction of the steel strip is controlled by shifting the position of the single-end-tapered work roll by a method comprising the steps of: measuring the amount of edge drop at each widthwise ends of the steel strip on the outlet side of the final stand; calculating the amount of the edge drop offset between the measured amount of the edge drop and a target amount of the edge drop on the final stand outlet; and individually shifting the position of the vertically disposed single-end-tapered work rolls in accordance with the amount of the edge drop offset at the widthwise ends.

The edge drop may be calculated from equation (1) as follows:

$$\Delta hed = (tce - ted) - (t0ce - t0ed) \quad (1)$$

Δhed = amount of edge drop at the widthwise end of the steel strip. (mm)

tce = measured thickness at the widthwise central portion of the steel strip adjacent to the outlet side of the final stand. (mm)

ted = measured thickness at the widthwise end portion of the steel strip adjacent to the outlet side of the final stand. (mm)

t0ce = target thickness at the widthwise central portion of the steel strip adjacent to the outlet side of the final stand. (mm)

t0ed = target thickness at the widthwise end portion of the steel strip adjacent to the outlet side of the final stand. (mm)

Further objects, features and advantages of the invention will appear more fully when considered in view of the following drawings and description.

DESCRIPTION OF THE PREFERRED EMBODIMENTS

Figure 1:
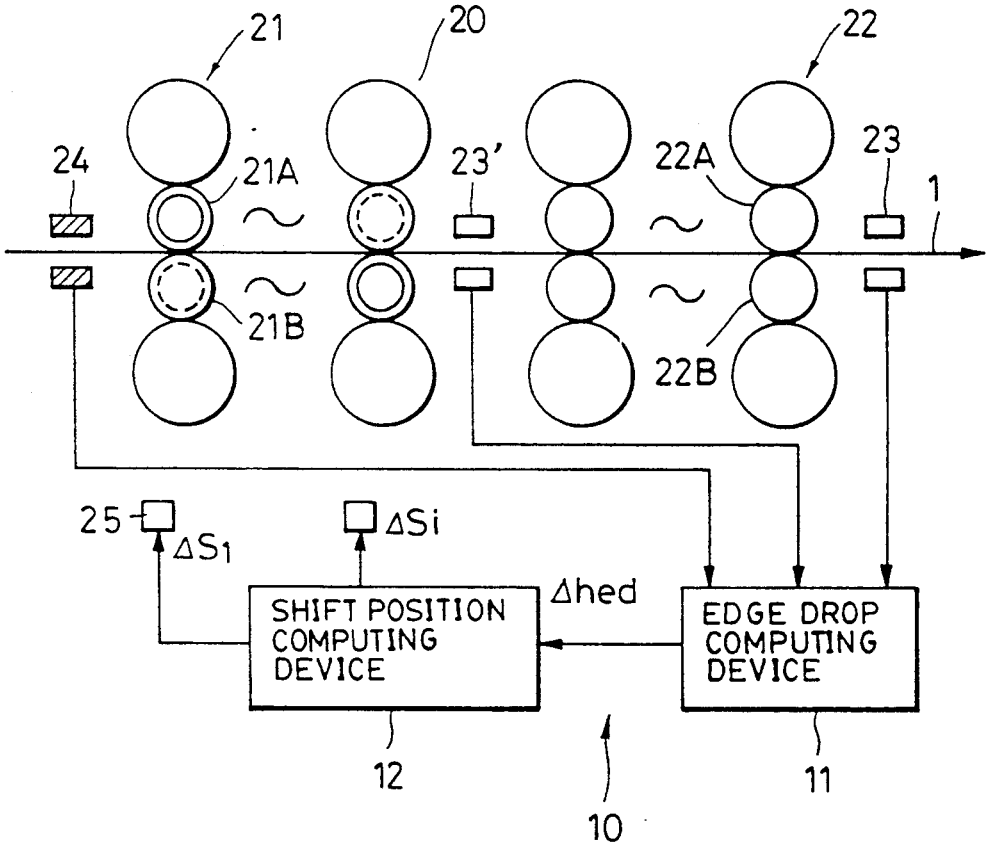
FIG. 1 illustrates a control system for an example of an edge drop control apparatus according to an embodiment of the present invention.

FIG. 1 illustrates a control system of an edge drop controlling apparatus 10 for use in an embodiment of an edge drop control method according to the present invention.

Figure 2:
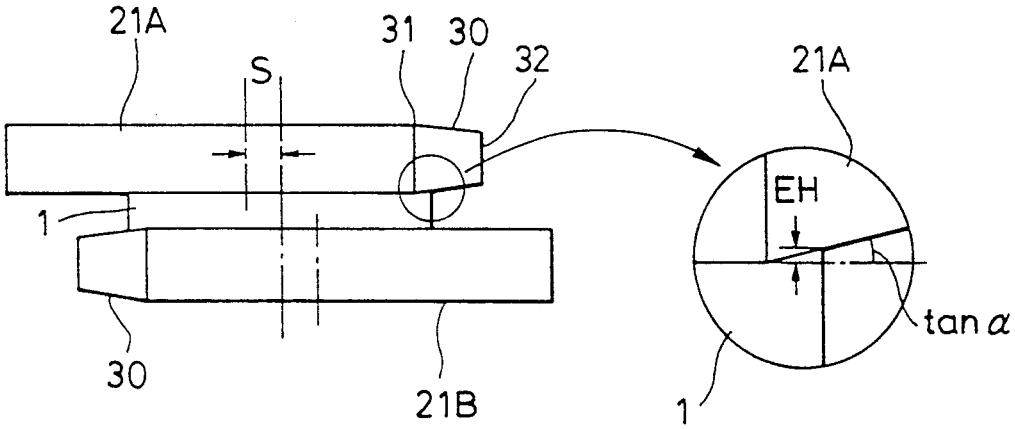
FIG. 2 illustrates the concept of improving the edge drop by means of a single-end-tapered work roll according to the present invention.

Referring now to FIGS. 1 and 2, a tandem cold rolling mill stands 20 comprises one or more rolling mills 21 capable of shifting a pair of vertically disposed and single-end-tapered work rolls 21A and 21B. The work rolls are arranged in such a manner that taper portions 30, ground to form a pointed shape, are positioned on the two side end edges of a steel strip 1. The rolling mills 21 are sequentially disposed on one or more stands including a first stand. Furthermore, a rolling mill 22 including a pair of vertically disposed plain rolls 22A and 22B is disposed at least at the final stand adjacent to the outlet. The rolling mill stands 20 are provided with edge drop gauges 23 disposed adjacent to the outlet of the rolling mill 22 on the final stand. The edge drop gauges 23 respectively measuring the amount of edge drop on the operation side and drive side widthwise end portions of the steel strip 1.

Figure 3:
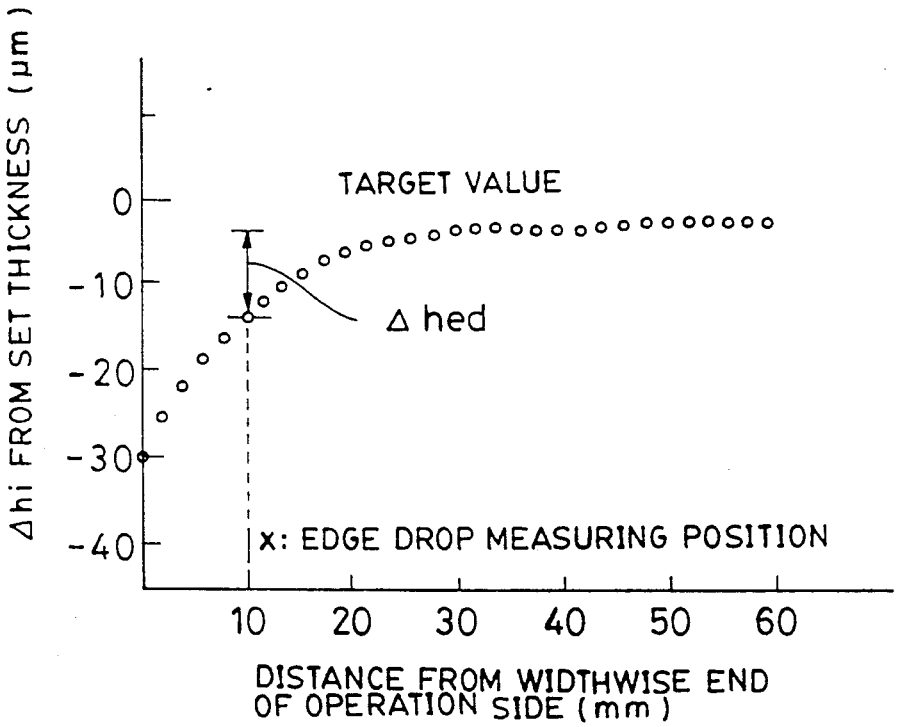
FIG. 3 is a graph which illustrates an example of the output from an edge drop gauge.

The edge drop gauge 23 is arranged in such a manner that thickness gauges are disposed at small intervals along the widthwise direction. The gauge 23, therefore, detects changes in the thickness of the strip along the widthwise direction. The gauge 23 then transmits the offset of the thickness at a position inside from the end portion of the strip by a certain distance from a set thickness the edge drop control unit 10. FIG. 3 is a graph which illustrates output values from the operation side edge drop gauge 23.

The tandem cold rolling mill stands 20 have shift devices 25 to shift the position of each pair of vertically disposed and single-end-tapered work rolls 21A and 21B.

An edge drop control unit 10 comprises an edge drop computing device 11 and a shift position computing device 12 for controlling the shift devices 25.

The edge drop computing device 11 computes the edge drop offset amount Δhed to be controlled by the edge drop control unit 10 based on the results of the measurements made by the edge drop gauge 23 in accordance with equation (1) below:

$$\Delta hed = (tce - ted) - (t0ce - t0ed) \quad (1)$$

Δhed = amount of edge drop at the widthwise end of the steel strip. (mm)

tce = measured thickness at the widthwise central portion of the steel strip adjacent to the outlet side of the final stand. (mm)

ted = measured thickness at the widthwise end portion of the steel strip adjacent to the outlet side of the final stand. (mm)

t0ce = target thickness at the widthwise central portion of the steel strip adjacent to the outlet side of the final stand. (mm)

t0ed = target thickness at the widthwise end portion of the steel strip adjacent to the outlet side of the final stand. (mm)

The operation side edge drop offset amount ΔhedOp and drive side edge drop offset amount ΔhedDr are calculated from Equation (1). In order to individually change the shift portions of the single-end-tapered work rolls 21A and 21B in accordance with the thus-obtained edge drop offset amounts ΔhedOp and ΔhedDr, the shift amount ΔSju for the upper single-end-tapered work roll 21A and shift amount ΔSjd for the lower single-end-tapered work roll 21B are calculated.

In a case where the upper single-end-tapered work roll 21A at the stand j is ground to be formed into a pointed shape facing the operation side with respect to the operation side edge drop offset amount ΔhedOp, the shift amount ΔSju for the upper single-end-tapered work roll 21A can be calculated from Equation (2) (shifting is assumed to be positive in a direction in which the edge drop is improved):

$$\Delta Sju = 1/\xi j \cdot 1/\tan \alpha ju \cdot hedOp \quad (2)$$

αju = the taper angle of the upper single-end-tapered work roll on the stand j.

ξj = influence coefficient of the geometrical gap amount (EH; see FIG. 2) at the edge portion of the stand j with respect to the edge drop amount on the outlet side of the tandem rolling mill stands.

In a case where the upper single-end-tapered work roll 21A is ground to be formed into a pointed shaft facing the driving side, ΔhedOp can be calculated as ΔhedDr in Equation (1). The shift amount ΔSjd for the lower single-end-tapered work roll 21B at the stand j can similarly be calculated from Equation (2). Since the single-end-tapered work roll on the operation side and that on the driving side are ground to form pointed shapes opposing one another, the shifting is positive even though the directions of the shifts are made to oppose one another in the case where the edge drop is improved in both directions.

Equation (2) is used to calculate the shift amount when the amount of edge drop is modified by changing only the amount of shift at only the stand j. In a case where the edge drop is modified by the amount of changes of the shifts at more than one stand, offset amounts ΔhedOp and ΔhedDr for each edge drop offset amount must be distributed to each of the stands at an arbitrary rate to perform calculations in accordance with Equation (2).

The shift position computing device 12 discriminates the result of the computations made by the edge drop computing device 11 as shown in (a) and (b) to control the shift devices 25.

(a) In a case where the single-end-tapered work rolls 21A and 21B do not perform shifting in the same direction (ΔSju, ΔSjd>0 or ΔSju, ΔSjd<0), the upper single-end-tapered work roll 21A is shifted by ΔSju and the lower single-sided work roll 21B is shifted by ΔSjd.

(b) In a case where the single-end-tapered work rolls 21A and 21B perform shifting in the same direction (ΔSju>0 and ΔSjd<0 or ΔSju<0 and ΔSjd>0) and (1) if |ΔSju|>|ΔSjd|, the upper single-end-tapered work roll 21A is shifted before the lower single-end-tapered work roll 21B is shifted. (2) if |ΔSjd|>|ΔSju|, the lower single-end-tapered work roll 21B is shifted before the upper single-end-tapered work roll 21A is shifted.

The shift position computing device 12 is used to make the above-described discrimination. Control is performed in such a manner that both the vertically disposed single-end-tapered work rolls 21A and 21B are shifted in opposing directions or either of the two work rolls 21A or 21B is stopped and then the remainder roll 21A or 21B is shifted in the same direction. Therefore, the steel strip 1 is not applied with force from the vertically disposed single-end-tapered work rolls 21A and 21B shifting in the same direction. As a result, the zigzag movement of the steel strip 1 in the widthwise direction can be prevented.

A modification may be employed where either of the single-end-tapered work rolls is shifted by lowering the shifting speed to reduce the force which will be given to the steel strip 1 from the single-end-tapered work roll in the widthwise direction. Furthermore, the thickness gauges may be disposed adjacent to the inlet portion of the tandem rolling mill stands 20 as shown in FIG. 1.

The edge drop computing device 11 computes edge drop offset amount Δhed to be controlled by the edge drop control unit 10 from above-described Equation (1) in accordance with the results of the measurements made by the edge drop gauge 23 and the thickness gauge 24, respectively. Assuming that the distance from the widthwise end, which is set as a predetermined edge drop control position, is x 0, the edge drop measurement position x is changed to a position which can be obtained from the following Equation (3) where the width is larger than the set width by ΔW:

$$x = x0 + \Delta W/2 \quad (3)$$

where x=edge drop measuring position (the distance from the widthwise end).

x0=set value of the edge drop control position.

ΔW=width offset amount (offset amount from the set width).

The difference between the measured edge drop amount and the target edge drop amount at the above-described edge drop measuring position x is transmitted as edge drop offset amount Δhed, as shown graphically in FIG. 3.

The shift position computing device 12 obtains the shift change amount ΔSj of each of the single-end-tapered work rolls 21A and 21B in order to maintain the edge drop offset amount hed computed by the edge drop computing device 11 at zero. In accordance with thus obtained ΔSj, the shift device 25 adjusts the work rolls.

Figure 4:
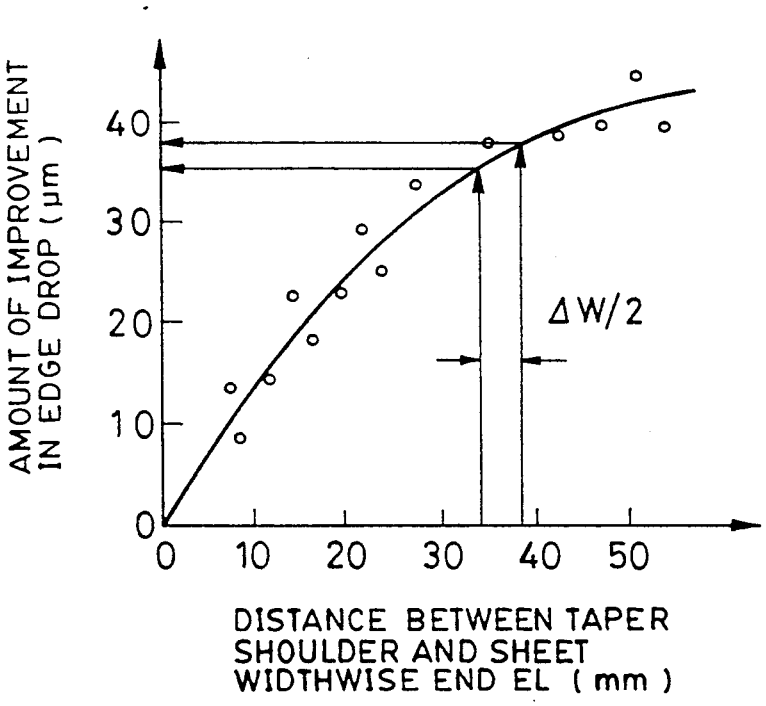
FIG. 4 is a graph which illustrates the relationship between the amount of improvement in the edge drop and the distance from the taper shoulder portion of the single-end-tapered work roll to the widthwise end portion.

The relationship between the distance from a taper shoulder portion 31 to a width end 32 of the single-end-tapered work roll and the improvement in edge drop is shown in FIG. 4. In a case where the width is changed in a state where the single-end-tapered work roll is fixed and the width offset amount ΔW is widened, the distance from the taper shoulder portion 31 of the single-end-tapered work roll and the width end portion 32 is elongated by ΔW/2. Hence, the amount of the improvement is changed from a state in which the edge drop is first improved at point a. Therefore, the single-end-tapered work roll is shifted by an amount corresponding to the half width offset amount ΔW so that the change in the amount of the improvement in the edge drop is eliminated while maintaining the distance from the taper shoulder portion 31 to the width end 32. In this case, the shift amount ΔSj is expressed by Equation (4):

$$\Delta Sj = W/2 \quad (4)$$

The amount of shift made by the rolling mill disposed in the upper stream stand must be changed by the feed/forward method in accordance with the change in the width measured by the width gauge 24.

In a case where the above-described two methods are used simultaneously, the values obtained from Equations (2) and (3) are added to each other and the shift amount ΔSj is then subtracted.

Another structure may be employed in which the tandem cold rolling mill stands 20 are provided with edge drop gauges 23' along the widthwise ends of the steel strip 1. The gauges 23' are disposed on the operation and driving sides of the outlet side of the final stand (stand i) of the stands having the rolling mills 21 capable of shifting vertically disposed single-end-tapered work rolls 21A and 21B.

The edge drop control unit 10 comprises the shift position computing device 11 on the outlet side of the stand i and a target edge drop computing device 12.

The shift position computing device 12 obtains edge drop offset Δhedi between the measured edge drop on the outlet side of the stand i and the target edge drop on the above-described outlet side of the stand i in accordance with the results of the measurement made by the edge drop gauge 23'. Furthermore, shift change amount ΔSj to be given to each shift device 25 for the first to the i-th stands is determined by Equation (5) in order to maintain the amount of edge drop on the outlet side of the stand i in accordance with Δhedi.

$$\Delta Sj = i/\xi ji \cdot hedi/tan\alpha j \quad (5)$$

where

αj; taper angle at the tapered portion of the work roll at the stand j.

ξji; influence coefficient of the geometrical gap (EH; see FIG. 2) of the edge portion at the stand j with respect to the amount of the edge drop between the outlet side stands of the stand i.

Improved control response is thereby obtained because the shift device 25 and the edge drop gauge 23' are positioned closer to each other. A desired control effect can be obtained even if the thickness at the widthwise end portion of the steel strip or the operational condition of the rolling mill is changed as in the case of a speed acceleration or deceleration. However, the control performed in accordance with Equation (5) serves only to maintain the edge drop on the outlet side of the stand i. The steel strip 1 is caused to pass through the plain roll-shaped rolling mill group so that the edge drop of the cold rolled product is measured at the above-described tandem outlet side. The target edge drop computing device 11 obtains the edge drop offset Δhedn between the measured edge drop on the tandem outlet side and the measured edge drop in accordance with the result of the measurement made by the edge drop gauge 23' in order to make coincide the edge drop of the cold rolled product with a target edge drop. In accordance with Δhedn thus-obtained, target edge drop, changed amount Δhedi between the stand i outlet side stands is transmitted to the edge drop control system which corresponds to the stand i outlet side stands.

The target edge drop changed amount Δhedi can be computed by the following Equation (6):

$$\Delta hedi = 1/\zeta i \cdot \Delta hedn \quad (6)$$

where

ζ8; influence coefficient of the amount of the edge drop between stand i outlet side stands upon the amount of the edge drop on the tandem outlet side.

As described above, the edge drop gauge 23' is disposed on the stand i outlet side, thereby permitting improved edge drop control response. Furthermore, since the tandem outlet side edge drop gauge 23 is present, control can be performed while maintaining the edge drop as the cold rolled product.

EXAMPLE 1

Figure 5:
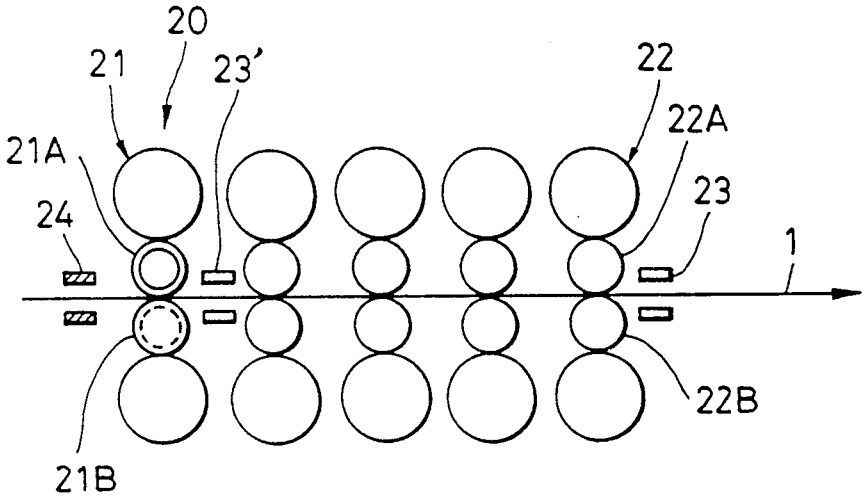
FIG. 5 illustrates a configuration of tandem cold rolling mill stands according to the present invention.

A steel strip having a width of 1100 mm and a thickness of 2.6 mm was cold-rolled to reduce its thickness to 0.3 mm by a five stand tandem cold rolling mill as shown in FIG. 5. A rolling mill capable of shifting a single-end-tapered work roll in the widthwise direction was mounted on a No. 1 stand, while disposing an edge drop gauge on the final stand outlet side. According to this example, the operation side of the upper single-end-tapered work roll was ground to form a pointed shape and the drive side of the lower single-end-tapered work roll was also ground to form a pointed shape.

The following rolling operations were then performed: a conventional control method in which the vertically disposed single-end-tapered work rolls at the No. 1 stand was shifted in opposing directions by the same quantity in order to make coincide the average value of the edge drop at the two widthwise ends on the operation side and the drive side with a target value; and a control method according to the present invention in which the single-end-tapered work rolls on the No. 1 stand were individually shifted in the same direction in order to make the edge drop on the operation side and that on the drive side individually coincide with the target value in such a manner that the vertically disposed rolls were not shifted simultaneously.

Figure 6:
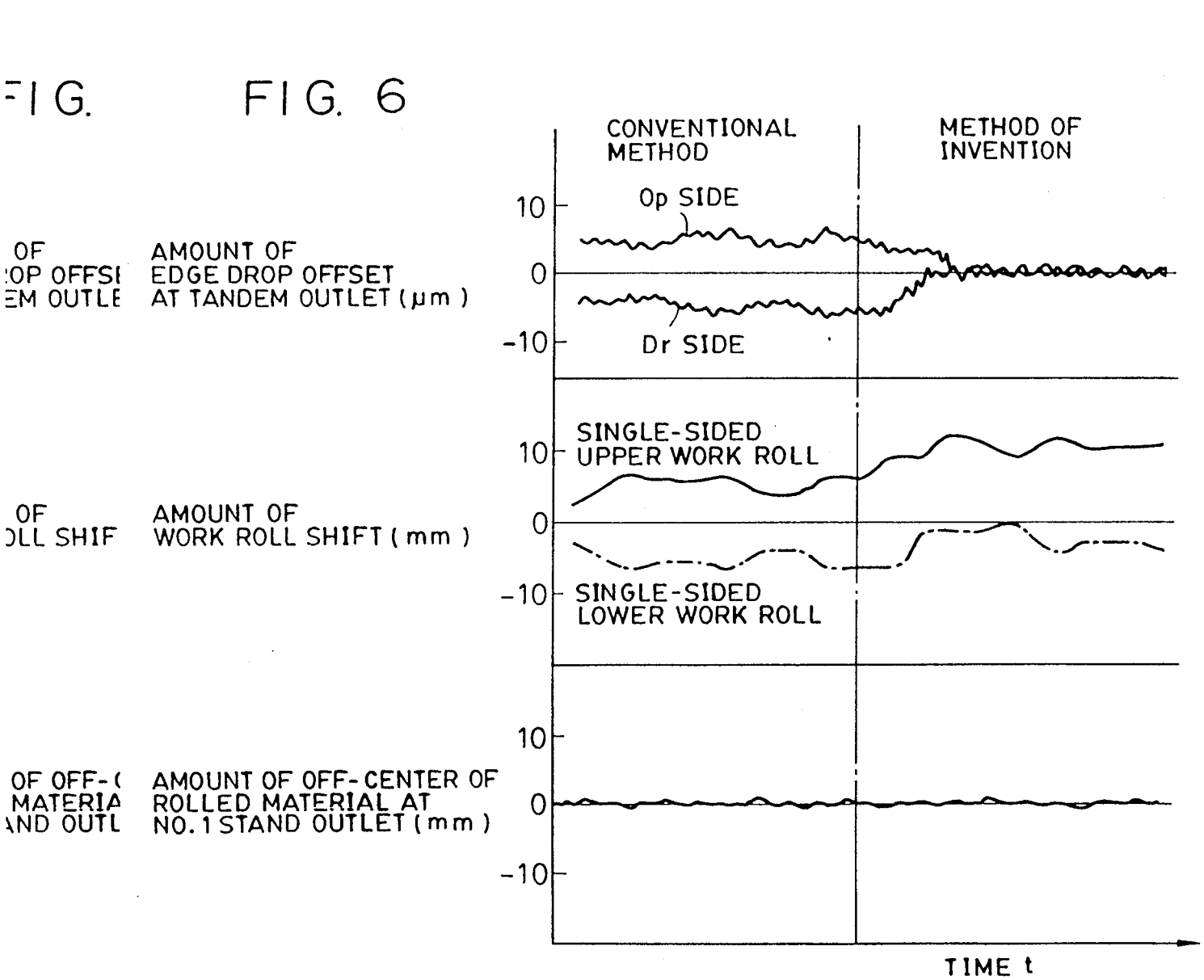
FIGS. 6 to 8 are graphs which illustrate effects of the improvements in the edge drop according to the embodiments of the present invention.

FIG. 6 illustrates the edge drop offset on the operation side and that on the drive side at the outlet of the tandem rolling mill stands, the amount of shift of the single-end-tapered work roll (shifting toward the drive side is assumed to be positive) and the amount of off-center of the steel strip on the No. 1 stand outlet (off-center toward the drive side is assumed to be positive). According to the conventional method, the control was simply performed so that the average value of the edge drop on the two widthwise ends would coincide with the target value. Therefore, an edge drop offset of +3 to +5 μm was generated on the operation side and that of −3 to −5 μm was generated on the drive side. According to the method of the present invention, both of the single-end-tapered work rolls were shifted toward the drive side in order to eliminate the above-described offset. The vertically disposed single-end-tapered work rolls were shifted one at a time to prevent moving the workpiece to be rolled off-center. The difference in the edge drop between the operation side and the drive side were eliminated and both the operation side and the drive side were controlled relative to the target value, thereby causing the offset to be substantially eliminated.

EXAMPLE 2

A mother strip having a width of 1100 mm and a thickness of 2.6 mm was cold-rolled to reduce its thickness to 0.3 mm by a five stand tandem cold rolling mill as shown in FIG. 5. A rolling mill capable of shifting the single-end-tapered work roll in the widthwise direction was disposed on the No. 1 stand, the edge drop gauge was then disposed on the final stand outlet and the width gauge was disposed on the tandem rolling mill inlet side.

The following rolling operations were then performed: a conventional method in which control was performed by using only the output from the edge drop gauge on the final stand outlet side; and a method according to the present invention in which control was performed by using the output from the edge drop gauge. The gauge output was taken after the position at which the edge drop was changed in accordance with the width offset measured by the width gauge disposed on the tandem rolling mill input side to maintain the distance from the taper shoulder portion of the single-end-tapered work roll to the widthwise end at a predetermined distance.

Figure 7:
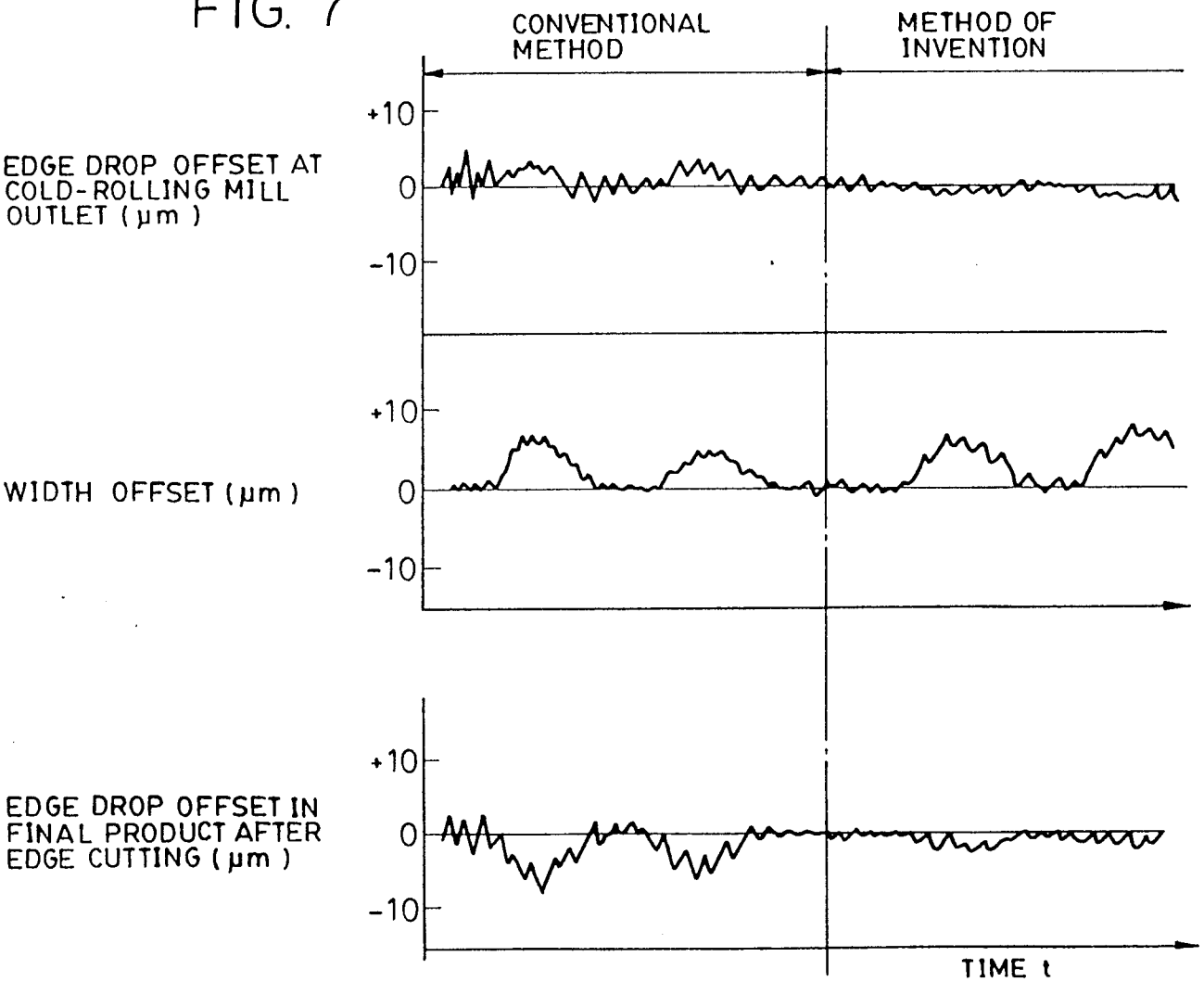

FIG. 7 illustrates the edge drop offset at the time of the rolling operation, the width offset, and the edge drop offset after the edge has been cut (the steel strip was conveyed at the same speed as that at the time of the above-described rolling operation to make each position coincide with each other). According to the conventional method, the edge drop at the positions of the same distance from the widthwise end are measured to perform the control even if there is width offset. Therefore, control is performed in such a manner that the edge drop at a position further adjacent to the widthwise end is the target value rather than the instructed control position for the final product if the width becomes larger. As a result, the edge drop becomes smaller than the target value at the instructed control position, causing the offset to deviate considerably toward a positive value (as for the thickness, it becomes thicker). According to the present invention, the position at which the edge drop is measured in accordance with the width offset and the taper shoulder position of the single-end-tapered work roll is changed in accordance with the width change. Therefore, the edge drop on the cold rolling mill outlet side can be decreased. Furthermore, since the edge drop is measured at the same position as the cold rolling mill outlet side, after the edge cutting, the edge drop offset after edge cutting can also be reduced.

EXAMPLE 3

A mother strip having a width of 1100 mm and a thickness of 2.6 mm was cold-rolled to reduce the thickness to 0.3 mm by a five stand tandem cold rolling mill as shown in FIG. 5.

The rolling mill capable of shifting the single-end-tapered work roll along the widthwise direction of the strip was mounted on the No. 1 stand. Edge drop gauges were disposed on the No. 1 stand outlet side and the final stand outlet side, respectively.

The following rolling operations were then performed: a conventional method in which control was performed by using only the edge drop gauge disposed on the final stand outlet side; and a method according to the present invention in which two edge drop gauges were disposed on the final stand outlet side and the No. 1 stand outlet side, respectively. The edge drop between the No. 1 stand outlet side stands was maintained at a constant value and a correction was performed so as to prevent any deviation of the edge drop on the final stand outlet side.

Figure 8:
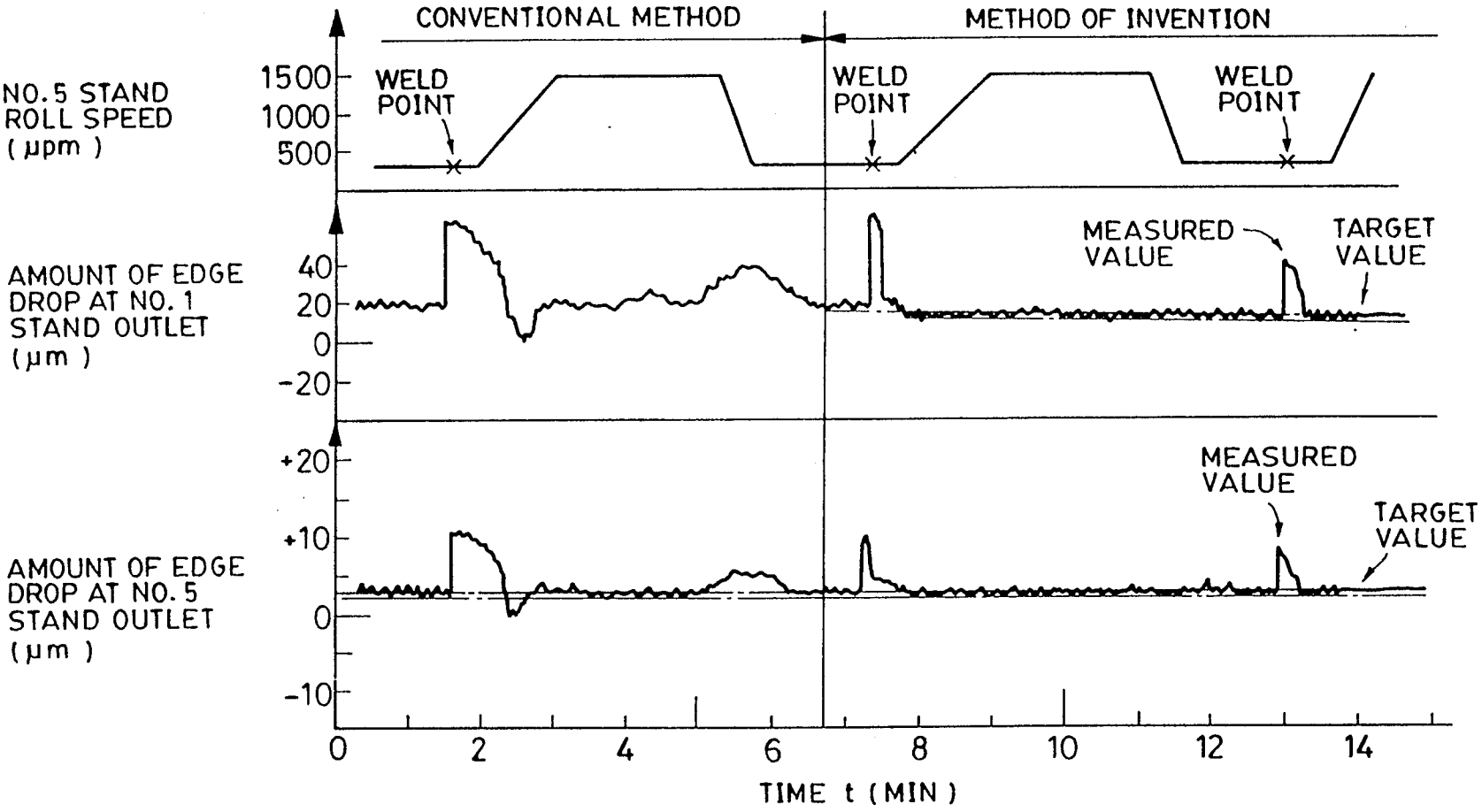

FIG. 8 illustrates the rolling speed, the output from the edge drop gauge at the No. 1 stand and at the final stand and the time sequential change in the target value. According to the conventional method, the amount of the edge drop considerably increases in the steel strip (at the leading portion of the hot rolled plate) immediately after passing the weld point. The edge drop on the No. 5 stand outlet side cannot reach the target value because the control response is too slow. Furthermore, the change in the edge drop due to the change in the coefficient of friction and the rolling load in the speed accelerated/decelerated region becomes excessively large. According to the present invention, however, an improvement was realized in the rate of change in the edge drop immediately after passing the weld point, thereby causing the offset to be reduced. Furthermore, the target edge drop on the No. 1 stand outlet is changed by the edge drop gauge on the No. 5 stand outlet side so that the edge drop on the No. 5 stand outlet side was included in the target value range. Since the target edge drop between the No. 1 stand outlet side stands was corrected at the next weld point, the amount of the target edge drop on the No. 5 stand outlet side reached a target value when the edge drop between the No. 1 stand outlet side stands had reached the target value.

As described above, according to the present invention, the offset of the edge drop at the widthwise ends can be eliminated and the edge drop made uniform along the lengthwise direction. In addition, a cold-rolled product exhibiting a reduced thickness offset in the widthwise direction can stably be manufactured while preventing the occurrence of operational problems such as contraction of the work-piece.

Although the invention has been described in its preferred form with a certain degree of particularly, it is understood that the present disclosure of the preferred embodiment may be changed in the details of construction and the combination and arrangement of parts without departing from the spirit and the scope of the invention as hereinafter claimed.

What is claimed is:

1. A method for controlling edge drop of a steel strip rolled through a tandem cold rolling mill including a first group of rolling stands and a second group of rolling stands, said first group of rolling stands having one or more rolling stands arranged in series with an inlet side and and outlet side and including at least a first stand, each said rolling stand of said first group having a pair of vertically spaced, axially shiftable single-end-tapered work rolls each being ground and tapered at one axial end, said single-end-tapered work rolls being arranged such that the tapered end of each said single-end-tapered work roll is positioned adjacent to a widthwise end of said steel strip, said second group of rolling stands arranged in series with an inlet side and an outlet side having at least one rolling stand including a final roll stand, each said rolling stand of said second group having a pair of vertically-spaced plain rolls, said method comprising:

measuring the width of said steel strip at the inlet side of said first group of rolling stands having the single-end-tapered work rolls and axially shifting each single-end-tapered work roll in accordance with the measured width in such a manner as to maintain a predetermined positional relationship between the tapered end of each single-end-tapered work roll and a respective adjacent widthwise end of said steel strip;

measuring an amount of edge drop appearing on each widthwise end of said steel strip at the outlet side of said first group of rolling stands, while axially changing a position of measurement of the edge drop amount on each widthwise end of said steel strip on the basis of the difference between the measured width and a final target width;

determining, in accordance with the following equation (1), an amount of offset of the edge drop amount from a final target edge drop amount at said outlet side of said first group of rolling stands; and controlling amounts of axial shifts of said single-end-tapered work rolls of each rolling stand independently of each c'her on the basis of the determined amount of offset of edge drop;

$$\Delta h_{ed}=(t_{ce}-t_{ed})-(t_{oce}-t_{oed}) \quad (1)$$

$\Delta h_{ed}$: amount of edge drop at a widthwise end of the steel strip (mm)

$t_{ce}$: thickness at a widthwise central portion of the steel strip as measured at the outlet side of the first group of rolling stands (mm)

$t_{ed}$: thickness at a widthwise end portion of the steel strip measured at the outlet side of the first group of rolling stands (mm)

$t_{oce}$: target thickness at a widthwise central portion of the steel strip adjacent at the outlet side of the first group of rolling stands (mm)

$t_{oed}$: target thickness at a widthwise end portion of the steel strip adjacent at the outlet side of the first group of rolling stands (mm)

2. A method as claimed in claim 1, wherein the target edge drop amount at the outlet side of said first group of rolling stands is changed on the basis of an amount of edge drop on each widthwise end of said steel strip as measured at said outlet side of said second group of rolling stands, and the amounts of axial shifts of said single-end-tapered work rolls of each rolling stand of the first group is controlled independently of each other on the basis of the amount of offset of edge drop determined at the outlet side of the first group of rolling stands.

3. A method as claimed in claim 1, wherein, in a case where both amounts of edge drop offsets at said widthwise ends are plus values or minus values, said vertically-spaced single-end-tapered work rolls are individually shifted in opposite roll-axis directions in accordance with each amount of the edge drop offset and, in a case where one of the amounts of the edge drop offsets is a plus value while the other is a minus value, both of said vertically-spaced single-end-tapered work rolls are shifted in the same roll-axis direction.

4. A method as claimed in claim 1, wherein the target edge drop amount at the outlet side of said first group of rolling stands is changed on the basis of an amount of edge drop on each widthwise end of said steel strip as measured at said outlet side of said second group of rolling stands, and the amounts of axial shifts of said single-end-tapered work rolls of each rolling stand of the first group is controlled independently of each other on the basis of the amount of offset of edge drop determined at the outlet side of the first group of rolling stands.

* * * * *